US006470652B1

(12) United States Patent
Piron

(10) Patent No.: US 6,470,652 B1
(45) Date of Patent: Oct. 29, 2002

(54) DEVICE FOR PACKAGING MATERIALS IN A VACUUM CHAMBER

(75) Inventor: Andrea Piron, San Salvatore Monferrato (IT)

(73) Assignees: Mauro Scolaro, Basiano (IT); Alessandro Bonanni, Vignale Monferrato (IT)

( * ) Notice: Subject to any disclaimer, the term of this patent is extended or adjusted under 35 U.S.C. 154(b) by 114 days.

(21) Appl. No.: 09/671,811

(22) Filed: Sep. 21, 2000

Related U.S. Application Data

(63) Continuation of application No. PCT/EP98/01756, filed on Mar. 25, 1998, now abandoned.

(51) Int. Cl.[7] ..... B65B 31/02

(52) U.S. Cl. ..... 53/511; 53/568; 53/373.4; 53/374.8

(58) Field of Search ..... 53/511, 512, 550, 53/562, 373.4, 373.7, 374.8, 375.6, 568

(56) References Cited

U.S. PATENT DOCUMENTS

| | | | | |
|---|---|---|---|---|
| 2,780,043 A | | 2/1957 | Hengsen | |
| 3,397,505 A | * | 8/1968 | Critchell | 53/374.8 |
| 3,516,223 A | * | 6/1970 | Anderson et al. | 53/373.4 |
| 4,177,622 A | | 12/1979 | Siegel et al. | |
| 4,697,401 A | * | 10/1987 | Kessler et al. | 53/373.4 |
| 5,001,884 A | * | 3/1991 | Hanagata | 53/511 |
| 5,177,931 A | * | 1/1993 | Latter | 53/374.8 |
| 5,966,898 A | * | 10/1999 | Su | 53/374.8 |

FOREIGN PATENT DOCUMENTS

| | | | |
|---|---|---|---|
| EP | 0 832 819 | 4/1989 | |
| EP | 0603704 | * 6/1994 | |
| GB | 974 529 | 11/1964 | |
| JP | 1-153429 | * 6/1989 | 53/373.4 |

* cited by examiner

*Primary Examiner*—Stephen F. Gerrity
(74) *Attorney, Agent, or Firm*—Guido Modiano; Albert Josif; Daniel O'Byrne

(57) ABSTRACT

A packaging device, particularly for foodstuffs or technical materials, comprising a bell-shaped vacuum chamber. A single-folded film can be placed in the vacuum chamber and the foodstuff can be inserted from the open longitudinal side of the film. Inside the bell-shaped vacuum chamber there is also provided a first transverse thermal bonding bar, which is laterally adjacent to a cutting blade, and a second thermal bonding bar, both bars being L-shaped. At least one nozzle for introducing gas is furthermore provided so as to face the longitudinal or transverse open side of the single-folded film.

17 Claims, 3 Drawing Sheets

DEVICE FOR PACKAGING MATERIALS IN A VACUUM CHAMBER

CROSS-REFERENCE TO RELATED APPLICATIONS

This application is a continuation of application Ser. No. PCT/EP98/01756 filed on Mar. 25, 1998 (now abandoned).

BACKGROUND OF THE INVENTION

The present invention relates to a packaging device, particularly for foodstuffs or technical materials.

Vacuum-forming machines with a bell-shaped chamber are currently known which comprise a vacuum pump connected to a chamber, also known as vacuum chamber, and inside which a preformed pouch, open on three sides, is usually placed; a foodstuff is placed inside the pouch.

Therefore, in these conventional machines the preformed pouch already contains the foodstuff when it is inserted in the vacuum chamber, then vacuum is formed inside the chamber and thermal bonding is carried out at the free side of the preformed pouch.

This conventional technology entails the need to use preformed pouches, whose size is therefore comparable to the size of the product; considerable manual labor is also required.

Accordingly, there are operating steps which extend the time required to achieve vacuum packaging of the product; moreover, if packaging occurs in a controlled atmosphere, most of the gas is wasted, since it is diffused not only in the pouch but mostly inside the vacuum chamber.

EP-603.704 is also known in which foodstuffs are packaged by using a plastic film which is guided through a folding station in order to obtain a double layer and is then thermally bonded so as to form pockets.

The pockets are provided with the intended size or capacity before being filled and sealed.

Thermal bonding and formation are followed by filling, closure and cutting of the resulting pockets or pouches: this solution, however, is complicated, in that it entails a plurality of separate stations for performing the individual operations to which the plastic film must be subjected sequentially.

Hot or cold formation of the plastic film is furthermore provided for, in addition to filling, by means of a nozzle, with liquid products, flours or finely granulated products, and therefore it is not possible to use the solution described for solid products having preset volumes, such as sliced ham and the like, meat, cheeses divided into portions, trays containing foodstuffs and non-food products.

Moreover, in the conventional described solution, in order to close the pocket or pouch it is necessary to make it pass through various operating steps, with the consequent need for optimum centering of the pouch at each station so as to allow the optimum intended treatment.

SUMMARY OF THE INVENTION

The aim of the present invention is to solve the above-described problems, by eliminating the drawbacks of the cited prior art and thus by providing a device which allows the vacuum or compensated-vacuum packaging of technical products or foodstuffs such as sliced ham or the like, meat, cheeses divided into portions, and trays containing food and non-food products.

Within the scope of this aim, an important object of the present invention is to provide a device which allows to package said products quickly and with limited personnel intervention.

Another important object of the present invention is to provide a product packaging device which has a reduced operating cycle with short execution times.

Another important object of the present invention is to provide a device in which said packaging can occur at a very low cost for each individual package.

Another important object of the present invention is to provide a device which also allows to use shrink-wrap films, optionally with the possibility to use a reduced amount of gas which is sufficient only for the package that contains the product.

Another object of the present invention is to provide a device which is also reliable and safe in use.

This aim, these objects and others which will become apparent hereinafter are achieved by a packaging device, particularly for foodstuffs or technical materials, which comprises a bell-shaped vacuum chamber, characterized in that at least one single-folded film can be placed in said bell-shaped vacuum chamber, said product or material being insertable from an open longitudinal side of said film, said bell-shaped vacuum chamber containing a first transverse thermal bonding bar, which is laterally adjacent to a cutting blade, and a second thermal bonding bar, said first and second bars being L-shaped, at least one nozzle for vacuum and/or for introducing gas or mixtures being provided so as to face one of said longitudinal open sides.

BRIEF DESCRIPTION OF THE DRAWINGS

Further characteristics and advantages of the present invention will become apparent from the following detailed description of two particular embodiments thereof, illustrated only by way of non-limitative example in the accompanying drawings, wherein.

DESCRIPTION OF THE PREFERRED EMBODIMENTS

Figure 1:
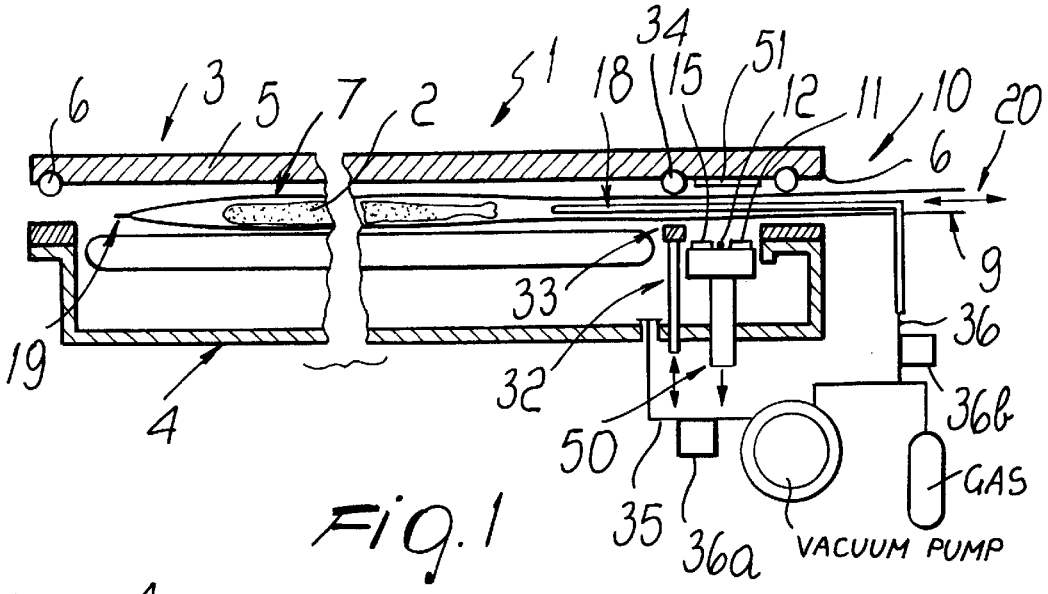
FIG. 1 is a partially sectional side view of the components of the device.

With reference to the above figures, the reference numeral 1 designates the packaging device particularly for technical materials or foodstuffs, which are designated by the reference numeral 2.

The device 1 comprises a bell-shaped vacuum chamber, designated by the reference numeral 3, which is substantially constituted by a lower container 4 and by a closeable upper cover 5; suitable first strips or gaskets 6 for airtightness are provided perimetrically with respect to the container 4 and the cover 5.

The device uses a single-folded film 7, which as such has a first longitudinal side 8 which is closed and a second longitudinal side 9 which is open.

A first thermal bonding bar 11 is arranged transversely inside the bell-shaped vacuum chamber 3 at its inlet 10; a substantially L-shaped cutting blade 12 is arranged laterally to said first thermal bonding bar 11, and a first wing 13 of the blade is parallel to the first thermal bonding bar 11, whilst the second wing 14 is arranged at right angles to the first wing in the direction of the advancement of the single-folded film 7.

A likewise L-shaped second thermal bonding bar 15 is provided adjacent to the cutting blade 12 and forms a third wing 16, which is adjacent and parallel to the first wing 13, and a fourth wing 17, which is adjacent and parallel to the second wing 14.

The first thermal bonding bar 11, the second thermal bonding bar 15 and the cutting blade 12 are advantageously but not necessarily associated with a same support 50 which is movable inside the bell-shaped vacuum chamber and work in abutment against suitable contrast elements 51 which are associated inside the cover 5.

The bell-shaped vacuum chamber 3 also contains at least one nozzle 18 which allows to produce vacuum and/or to inject gas or mixtures either at the second open longitudinal side 9 of the single-folded film or at the fourth transverse side 20 which is adjacent to the lateral inlet 10 of the bell-shaped vacuum chamber.

Figure 2:
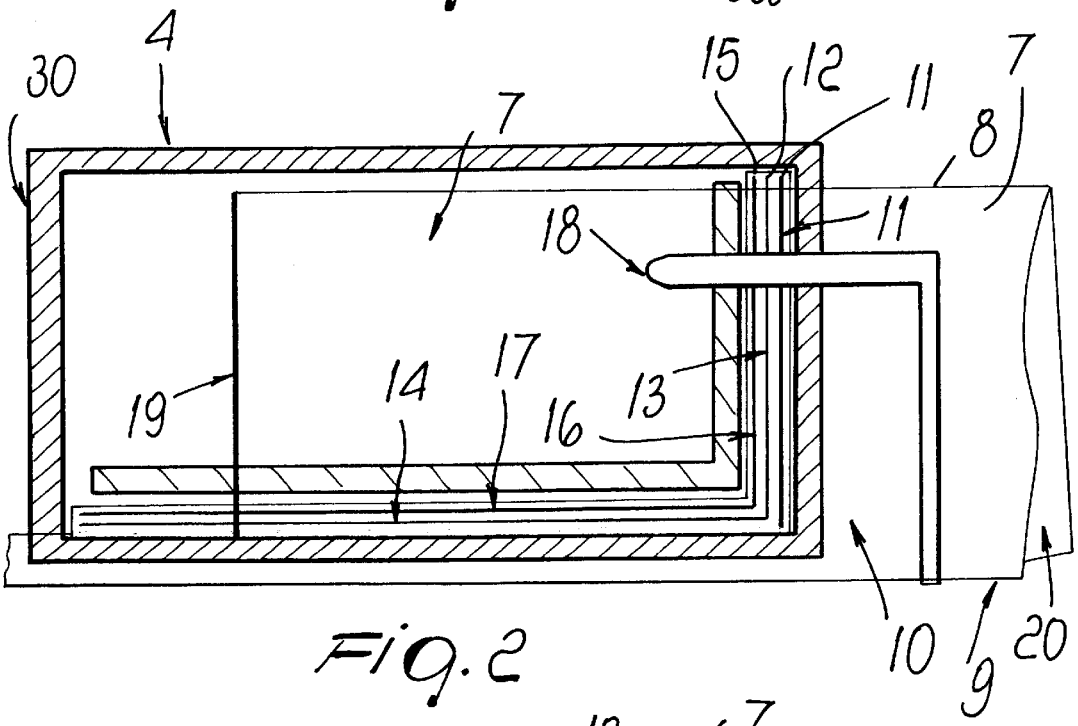
FIG. 2 is a top view of the device.
Figure 3:
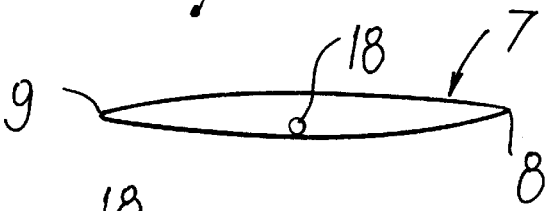
FIG. 3 is a view of the arrangement of the nozzle.
Figure 4:
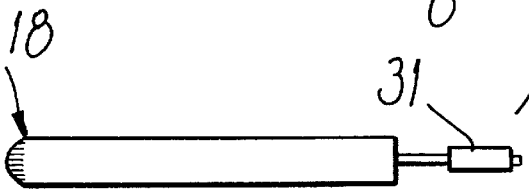
FIG. 4 is a different view of the nozzle.

The solution shown in FIG. 2 uses a nozzle 18 which has a lens-shaped cross-section and is inserted hermetically from the lateral inlet 10 of the bell-shaped chamber by means of a suitable piston 31.

Once vacuum or vacuum plus gas has been formed, the piston 31 causes the nozzle to retract in order to allow activation of the first and second thermal bonding bars 11,15 and of the cutting blade 12 so as to obtain a closed package 21.

In this case, there is provided a presser 32 which can move inside the bell-shaped chamber 3 and provides a seal because of the presence, at one of its ends, of a second strip or gasket 33 which works in contrast with a third strip or gasket 34 arranged inside the cover 5.

Preferably, the vacuum and/or the controlled atmosphere are produced in the bell-shaped chamber and inside the package 21 across a first path 35 and a second separate path 36, each whereof has a sensor 36*a* and 36*b* which detects and controls internal pressure.

Figure 5:
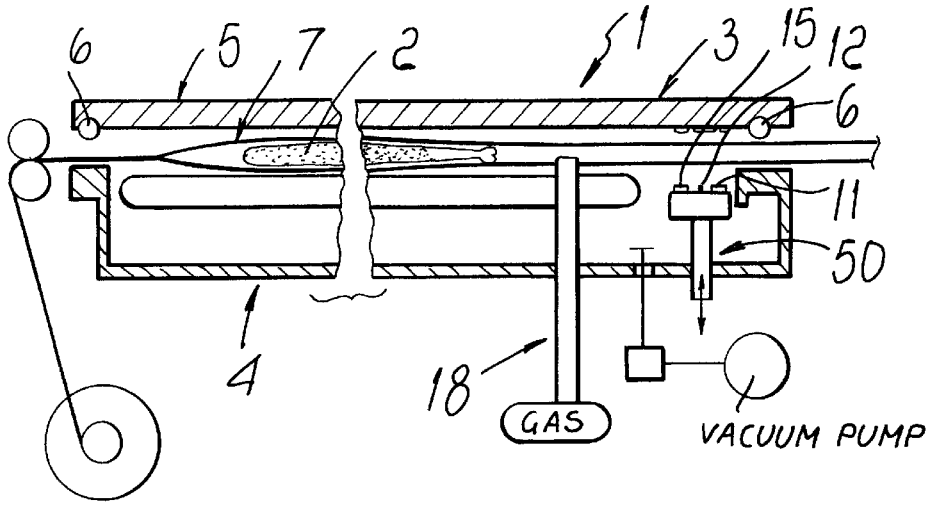
FIG. 5 is a partially sectional side view of the components of a second embodiment.
Figure 6:
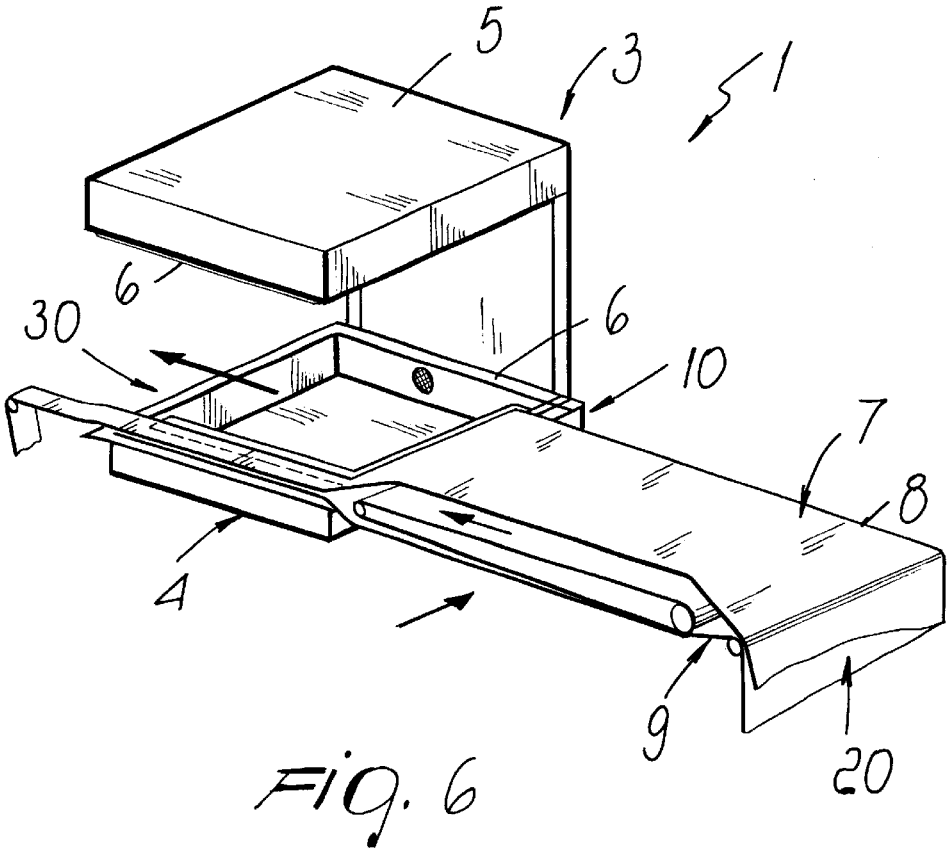
FIG. 6 is a perspective view of the components of the device of FIG. 5.
Figure 7:
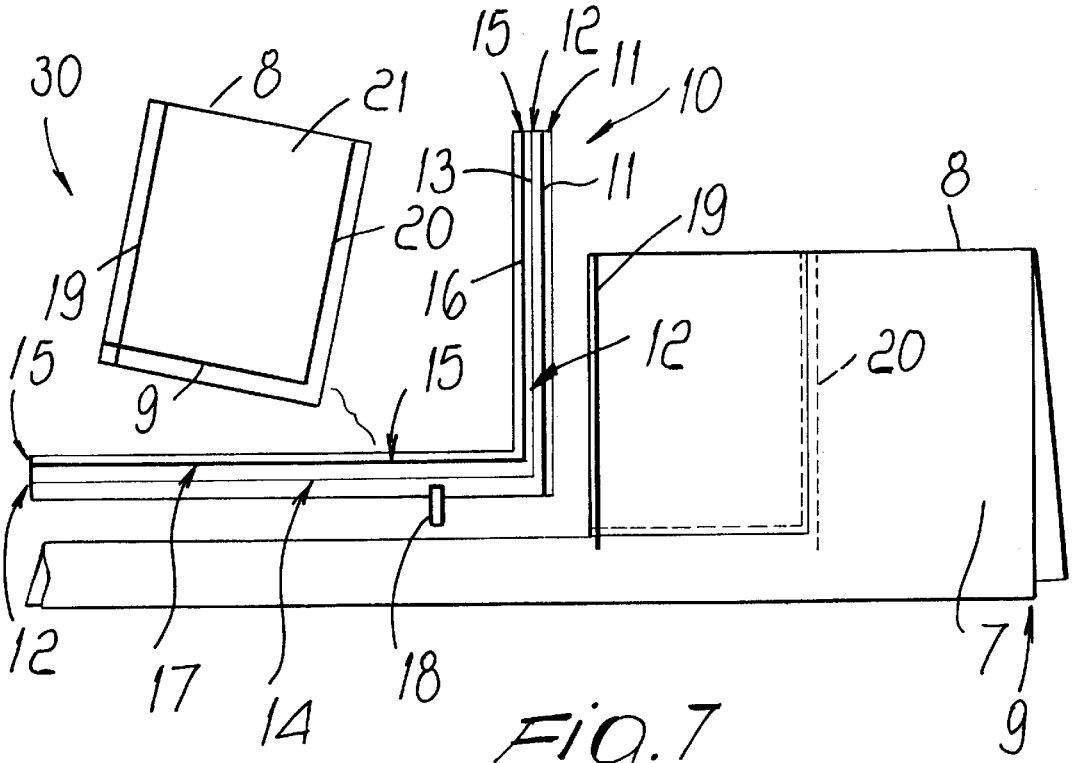
FIG. 7 is a schematic plan view of the components of the device of FIG. 5.
Figure 8:
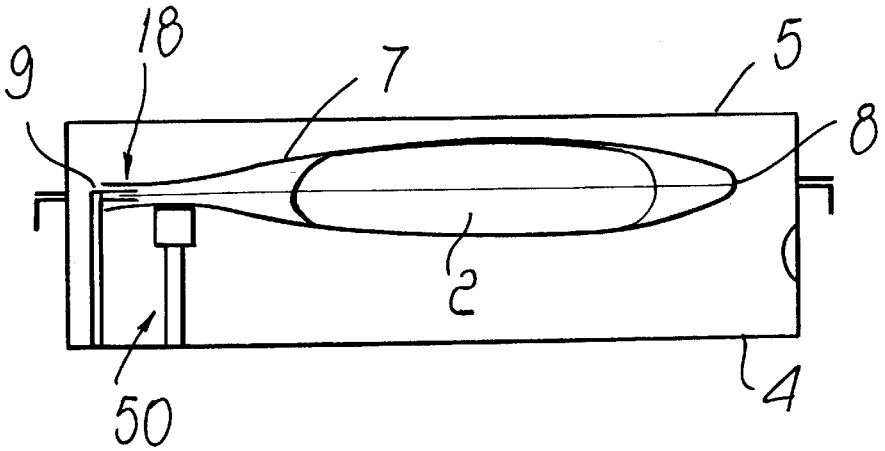
FIG. 8 is a sectional view, taken along a plane which lies transversely to the advancement of the film at the bell-shaped vacuum chamber of the device of FIG. 5.

In the solution shown in FIG. 5 there is provided only the support 50 for the first and second thermal bonding bars and the cutting blade, whilst the nozzle 18 is arranged at the second longitudinal side 9.

Use of the device is therefore as follows: assuming that the system is already in a steady-state operating condition, the third transverse side 19 of the single-folded film 7, which is adjacent to the lateral exit 30 in the bell-shaped vacuum chamber, is already partially sealed along its vertical extension; the operator then places the product 2 to be packaged inside the single-folded film through the second longitudinal side 9, which is open.

It is then sufficient to place inside the bell-shaped vacuum chamber the product contained in the single-folded film; thereafter, by lowering the upper closeable cover 5, the vacuum or vacuum-gas cycle begins.

Differently from the solution of FIG. 1, in the solution of FIG. 5 there is a cost improvement thanks to the fact that the nozzle 18 is laterally adjacent to the second open longitudinal side 9 of the single-folded film: if gas is introduced, use of the gas is limited only to the volume of the single-folded film which, being placed inside the bell-shaped vacuum chamber, assumes a pocket-like configuration, since the fourth transverse side 20 is clamped between the strips 6.

At the end of the vacuum or vacuum-gas cycle, the nozzle, which advantageously has a lens-shaped cross-section, injects gas or mixtures, if required; then the first thermal bonding bar 11 is activated, forming the third closed transverse side 19 of the next container or package 21 that can be obtained; then the second thermal bonding bar 15 is activated, closing both the fourth transverse side 20 and the second longitudinal side 9.

During this cycle, the product is not moved inside the bell-shaped chamber.

A closed package 21 is then obtained by activating the cutting blade 12.

It is thus possible to open the bell-shaped chamber, remove the resulting package and start a new cycle.

It has thus been shown that the invention has achieved the intended aim and objects, a device having been provided which, by using a single-folded film, allows to obtain a vacuum or controlled-atmosphere package even with shrink-wrap films by means of an operating sequence that occurs only at the bell-shaped vacuum chamber, without the need to handle the product, allowing to package solid products such as sliced ham or the like, meat, cheeses divided into portions and trays containing both foodstuffs and non-food products.

In the illustrated solutions, furthermore, formation and closure of the single-folded film occur at the bell-shaped vacuum chamber, simultaneously closing a transverse side of the next pouch, and all this occurs inside the bell-shaped vacuum chamber and during the same cycle.

It is also possible to use only the amount of gas required for the volume of the package that contains the product; all this allows to reduce the treatment times and costs of each individual package.

The invention is of course susceptible of numerous modifications and variations, all of which are within the scope of the same inventive concept.

The materials and the dimensions that constitute the individual components may also of course be the most pertinent according to specific requirements.

What is claimed is:

1. A packaging device for foodstuffs or technical materials, comprising a vacuum chamber, wherein at least one double layer single-fold film is insertable into said vacuum chamber with its fold line arranged parallel to a longitudinal side of the vacuum chamber, a product or material being insertable from an open longitudinal side of said film, said vacuum chamber containing a first transverse thermal bonding bar, which is laterally adjacent to a cutting blade and is arranged at an inlet of the chamber, and a second thermal bonding bar, said second thermal bonding bar being L-shaped and being arranged along the inlet traverse side and the longitudinal side of the vacuum chamber, opposite to the longitudinal side along which the fold line of the film is made to pass, at least one nozzle for vacuum and/or for introducing gas or mixtures being provided so as to face one of said longitudinal open sides.

2. The device according to claim 1, wherein said vacuum chamber is constituted by a lower container and an upper closeable cover which are perimetrically provided with first sealing strips or gaskets.

3. The device according to claim 2, wherein said first and second thermal bonding bars and said cutting blade are associated with at least one support which is movable inside said chamber and interact with contrast elements associated inside said cover.

4. The device according to claim 1, wherein said first thermal bonding bar, said second thermal bonding bar and said cutting blade are adapted to close the three open sides of the film to form at least one closed pouch.

5. The device according to claim 1, wherein said cutting blade is substantially L-shaped.

6. The device according to claim 5, wherein said cutting blade has a first wing which is adjacent to said first thermal bonding bar and a second wing which is arranged at right angles thereto.

7. The device according to claim 6, wherein said second thermal bonding bar has a third wing, which is adjacent to said first wing of said cutting blade, and a fourth wing, which is adjacent to said second wing of said cutting blade.

8. The device according to claim 7, wherein said second thermal bonding bar produces, at said third and fourth wings, the complete closure of the sides of said at least one double layer single-fold film so as to obtain a closed package.

9. The device according to claim 8, wherein said first thermal bonding bar, said cutting blade and said second thermal bonding bar are activated subsequently so as to obtain said package.

10. The device according to claim 1, wherein said second L-shaped thermal bonding bar is adjacent to said cutting blade.

11. The device according to claim 1, wherein said product is kept in a fixed position when the steps for producing vacuum and/or introducing gas or mixtures, for the thermal bonding and cutting of said at least one double layer single-fold film occur.

12. The device according to claim 1, wherein said first thermal bonding bar forms, at the end of each cycle, a third transverse side which is closed or partially closed for said at least one double layer single-fold film.

13. The device according to claim 1, comprising a first path and a second path for forming vacuum and/or injecting gas or mixtures, each path having a sensor for detecting and controlling the pressure inside said chamber and/or said double layer single-fold film.

14. The device according to claim 1, wherein said nozzle is hermetically inserted in, and extracted from, said vacuum chamber by means of a piston.

15. The device according to claim 14, wherein a presser is movable inside said vacuum chamber and has, at one of its ends, a second strip or gasket which acts in contrast with a third strip or gasket arranged inside said cover.

16. The device according to claim 1, wherein said nozzle is arranged at said second open longitudinal side of said double layer single-fold film.

17. The device according to claim 1, wherein said nozzle is arranged at a fourth transverse side of said double layer single-fold film, which is adjacent to the lateral inlet of said vacuum chamber.

* * * * *